US006360829B1

(12) United States Patent
Naber et al.

(10) Patent No.: US 6,360,829 B1
(45) Date of Patent: Mar. 26, 2002

(54) SOIL SAMPLING DEVICE

(76) Inventors: Ronnie J. Naber, 1711 Rd.12; Gregory G. Naber, 1008 Rd. R, both of York, NE (US) 68467

( * ) Notice: Subject to any disclaimer, the term of this patent is extended or adjusted under 35 U.S.C. 154(b) by 0 days.

(21) Appl. No.: 09/589,615

(22) Filed: Jun. 7, 2000

(51) Int. Cl.[7] ..... E21B 7/26

(52) U.S. Cl. ..... 175/20; 175/162; 175/58; 175/161; 175/252; 175/173; 175/11; 175/28; 175/144

(58) Field of Search ..... 175/19, 20, 58, 175/244, 249, 251, 252, 162; 173/2, 11, 28, 144, 185

(56) References Cited

U.S. PATENT DOCUMENTS

| | | | | |
|---|---|---|---|---|
| 4,191,263 A | * | 3/1980 | Malterer | |
| 4,284,150 A | | 8/1981 | Davis | 175/84 |
| 4,316,393 A | | 2/1982 | Philipenko | 73/864.45 |
| RE30,901 E | * | 4/1982 | Boxrud | |
| 4,333,541 A | | 6/1982 | Doty | 175/162 |
| 4,482,021 A | | 11/1984 | Repski | 175/209 |
| 4,685,339 A | | 8/1987 | Philipenko | 73/864.45 |
| 4,844,839 A | * | 7/1989 | Manchak | |
| 5,076,372 A | | 12/1991 | Hellbusch | 175/20 |
| 5,394,949 A | | 3/1995 | Wright et al. | 175/20 |
| 5,435,176 A | * | 7/1995 | Manchak | |
| 5,435,399 A | | 7/1995 | Peterson et al. | 175/20 |
| 5,445,229 A | | 8/1995 | Delima | 175/20 |
| 5,474,140 A | | 12/1995 | Stevens | 175/20 |
| 5,950,741 A | | 9/1999 | Wright et al. | 175/20 |

* cited by examiner

*Primary Examiner*—Roger Schoeppel
(74) *Attorney, Agent, or Firm*—Zarley, McKee, Thomte, Voorhees & Sease; Dennis L. Thomte

(57) ABSTRACT

The soil sampler of this invention is mounted on a wheeled vehicle and includes a frame having a pivotal mast which is movable between an upright position and a horizontally disposed position. An elongated, hollow soil probe is longitudinally movably mounted on the mast so that the probe may be inserted into the ground to collect a soil sample. When the sample has been collected in the soil probe, the probe is raised from the ground and the mast is moved from its upright position to its horizontally disposed position. The soil sample in the probe is automatically dumped from the probe when the mast has been moved to its horizontally disposed position. The soil sample is collected in a receptacle position below the probe with the receptacle being divided into at least two compartments. The soil sampling probe also includes means for indicating the true position of the soil surface.

9 Claims, 10 Drawing Sheets

SOIL SAMPLING DEVICE

BACKGROUND OF THE INVENTION

1. Field of the Invention

This invention relates to a soil sampling device and more particularly to a soil sampling device which is mounted on a vehicle and which is adapted to remove and collect sample cores from agricultural fields so that the farmer will know whether he needs to apply certain nutrients to the soil.

2. Description of the Related Art

Soil sampling devices or soil probes are used to collect samples from agricultural fields so that the farmer will know whether he needs to apply certain nutrients to the soil. In the early days, the soil probes were hand-driven into the soil with a core of soil being collected in the interior of the probe. Obviously, such manual probes were labor intensive and were difficult to insert in the ground. In later years, soil probes have been mounted on the front or rear ends of a truck or the like and utilize hydraulic cylinders to drive the probes into the ground. For example, see U.S. Pat. No. 4,333,541.

In certain of the prior art devices, it was necessary to manually remove the core of soil from the interior of the probe after the probe had been inserted into the ground and pulled therefrom. In certain other of the prior art devices, the samples had to be manually collected or dumped into a collection container. Further, in other prior art devices, it was necessary to manually clear the opening extending through the nose of the probe, since the soil being collected tended to collect or become clogged within that opening.

Further, many of the prior art machines or devices do not have sufficient power to penetrate hard soil and also lack the force necessary to pull the probe from "sticky" soil. As stated, many units on the market require the sampling tube or probe to be removed from the machine and inverted with the core of soil being manually forced from the tube by means of a rod or wire. To the best of applicants' knowledge, no known machine exists that can pull a surface sample and a deep sample at the same time with one probe and maintain those samples in a segregated condition. The existing equipment either requires two trips across a field at two different depth settings, or samples would have to be taken by hand.

With ever-increasing government regulations, farmers are being forced to sample deeper into the soil to control fertilizer leaching due to over-application of nitrogen or the like. However, it is not economically feasible to sample the deeper depths for the macro and micronutrients due to their limited availability to the growing plants at that depth. Hence the need for a machine that can overcome the limitations set forth above.

Yet another disadvantage of the prior art machines is that the soil probes thereof are not uniformly driven into the soil due to irregular terrain. For example, if the soil probe of the prior art machine is designed to penetrate the ground 24 inches, that depth will vary greatly due to the fact that if the probe is mounted on the rear of a vehicle and the vehicle is positioned on an uphill slope, the probe depth will be different than if the vehicle is positioned on a downhill slope. Thus, if the prior art machine is designed to insert the soil probe 24 inches into the ground, as described above, if the vehicle having the soil probe mounted thereon is on an uphill slope, the soil probe may be inserted into the ground greater than 24 inches. Conversely, if the prior art machine is designed to insert the probe 24 inches into the ground and the vehicle having the probe mounted thereon is on a downhill slope, the probe may not go into the ground the complete 24 inches.

SUMMARY OF THE INVENTION

The soil sampling device of this invention is mounted on a wheeled vehicle such as a truck, etc. The soil sampling device of this invention comprises a frame means secured to the vehicle having an elongated mast, having upper and lower ends, pivotally mounted on the frame means about a horizontal axis with the mast being pivotally movable between an upright position and a substantially horizontally disposed position. An elongated, hollow soil probe, having first and second ends, is longitudinally movably mounted on the mast and is movable from an upper retracted position to a lower soil penetrating position when the mast is in its upright position. The soil probe includes a conical-shaped soil-engaging nose portion at its first end and a cylindrical body portion extending therefrom towards the second end thereof. The cylindrical body portion includes first and second semi-cylindrical body members which are pivotally secured together, between open and closed positions, to enable a soil sample therein to be dumped therefrom when in the open position. An elongated soil sample collection receptacle is positioned beneath the cylindrical body portion when the probe is in its retracted position and the mast is in its horizontally disposed position.

The soil probe is driven into the ground with the soil sample being collected therein. After the soil probe has been inserted into the ground to collect the sample, the soil probe is moved upwardly to its upper position with respect to the mast and the mast is then pivotally moved to its substantially horizontally disposed position. Means is provided for automatically opening the cylindrical body portion so that the sample therein is dumped into the soil sample collection receptacle therebelow. The collection sample includes an upstanding wall portion which divides the sample being dumped thereinto so that a surface sample is segregated from a deeper sample. Means is also provided for automatically inserting a rod-like device through the conical-shaped nose portion of the probe to clear the nose portion of soil. The exterior surface of the conical-shaped nose portion has a plurality of longitudinally extending and protruding ribs provided thereon which help to fracture hard soil making penetration easier and which provides an air gap along the sides of the probe to break the suction which sometimes makes probe retraction difficult. The soil sampling device of this invention also includes a foot plate portion which contacts the soil surface to indicate the true position of the soil surface by means of a micro-switch mounted on a guide.

A principal object of the invention is to provide an improved soil sampling probe.

A further object of the invention is to provide a soil sampling probe having a nose cone provided thereon having ribs on the exterior surface thereof which help to fracture hard soil making penetration easier and which provides an air gap along the sides of the probe to break suction which sometimes makes probe retraction difficult.

Still another object of the invention is to provide a soil sampling probe including means for indicating the true position of the soil surface.

Still another object of the invention is to provide a soil sampling probe which allows for two segregated samples from the same probe cycle without the need for machine resetting.

Still another object of the invention is to provide a machine including a soil sampling probe which can pull a surface sample and a deep sample at the same time with one probe while maintaining the surface sample and deep sample in a segregated condition.

Still another object of the invention is to provide a soil probe machine having sufficient power to penetrate hard soil and sufficient power to pull the probe from sticky soil.

Still another object of the invention is to provide a device including means for automatically dumping the soil sample from the probe into a soil sample collection receptacle positioned therebelow.

Yet another object of the invention is to provide a soil sampling probe which collects samples at a much higher rate than prior art devices and which is easy to operate.

These and other objects will be apparent to those skilled in the art.

DESCRIPTION OF THE PREFERRED EMBODIMENT

Figure 1:
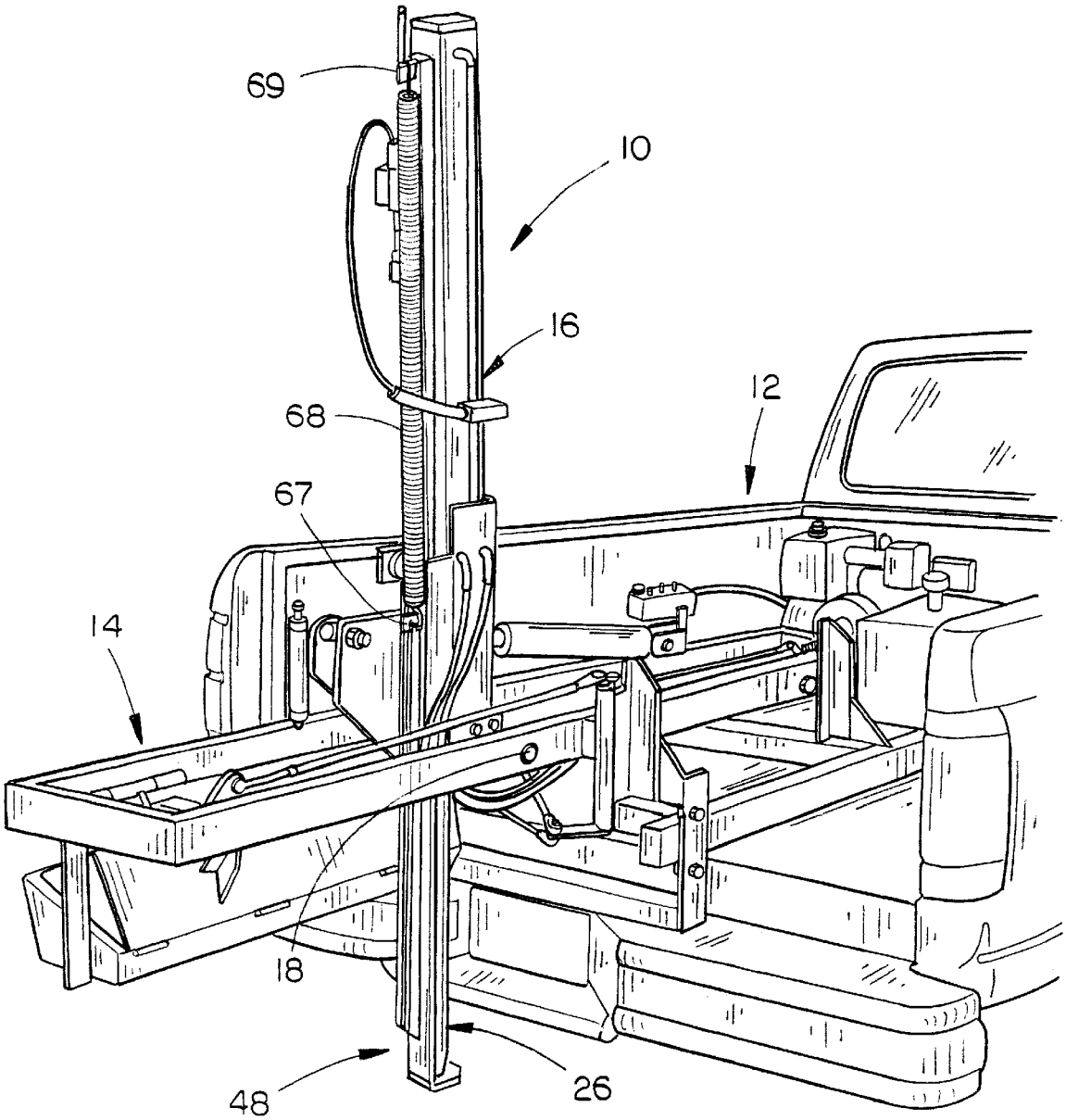
FIG. 1 is a rear view of the soil sampling probe of this invention mounted on the rear end of a truck.
Figure 6:
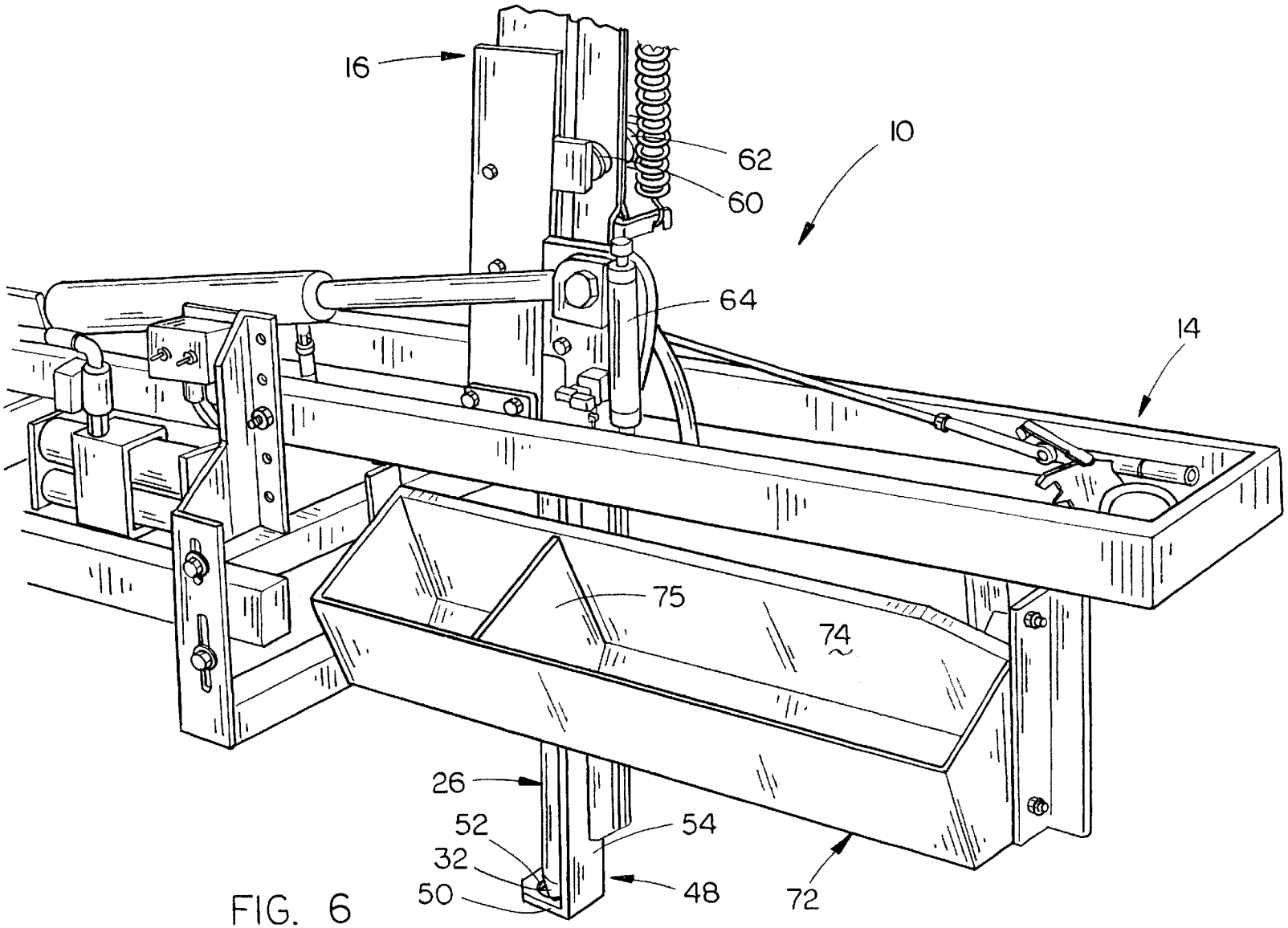
FIG. 6 is a partial rear perspective view of the apparatus of this invention.

The soil sampling probe assembly of this invention is referred to generally by the reference numeral 10 and is designed to be mounted on a wheeled frame such as a truck 12. The assembly 10 may be mounted at the forward end of the truck 12 or at the rearward end of the truck 12, as illustrated in the drawings. Assembly 10 generally includes a frame means 14 which is bolted or otherwise secured to the bed or box of the truck 12, as illustrated in the drawings. Mast assembly 16 is pivotally connected to the frame means 14 about a horizontal axis referred to generally by the reference numeral 18 and is pivotally movable between the upright position illustrated in FIG. 1 to the horizontally disposed position illustrated in FIG. 6. Hydraulic cylinder 20 is pivotally connected to the mast assembly 16 and the frame means 14 for pivotally moving the mast assembly 16 between its upright and horizontally disposed positions.

Figure 8:
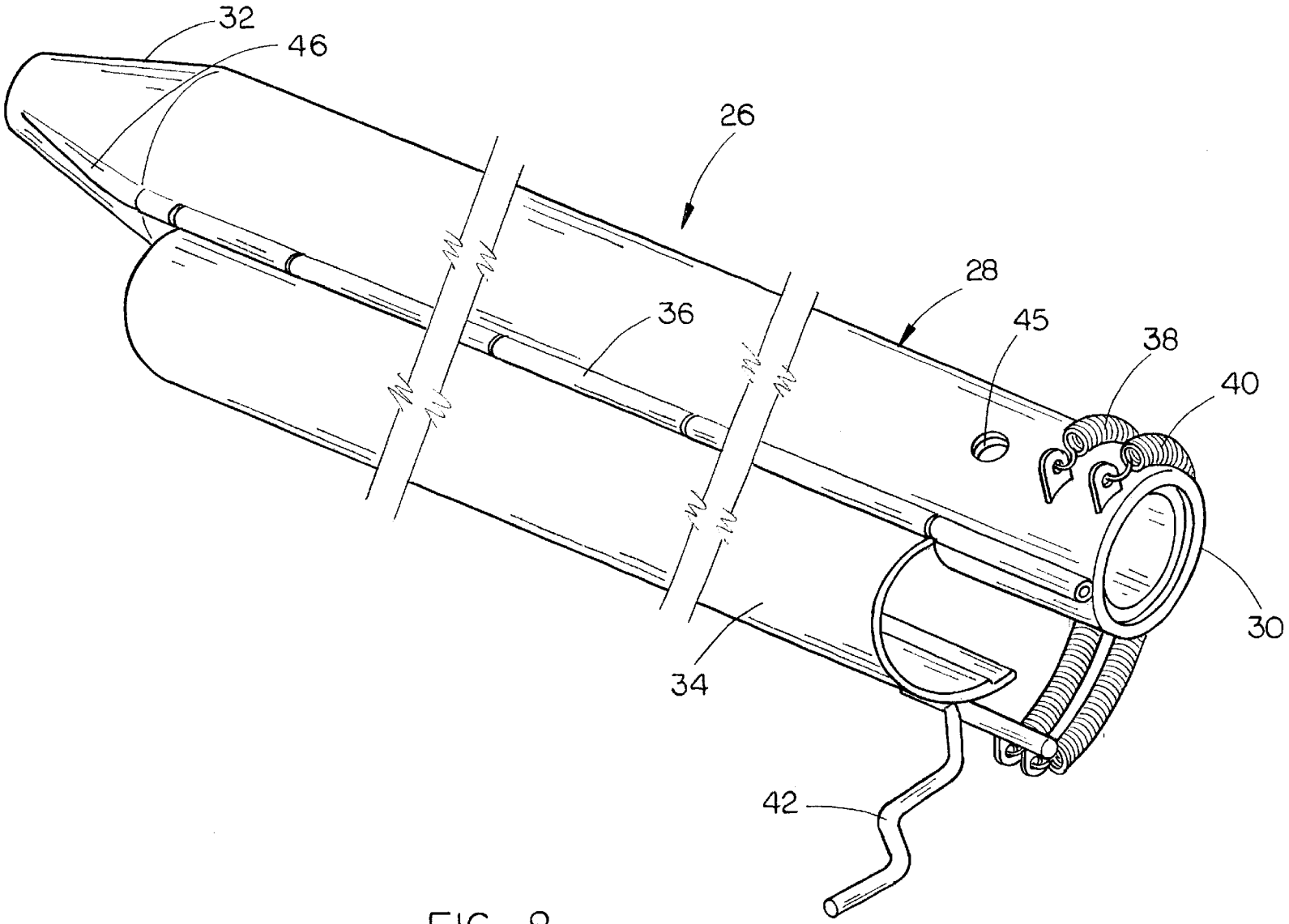
FIG. 8 is a partial perspective view of the soil probe of this invention in an open condition.

Hydraulic cylinder 22 is positioned in the interior of mast assembly 16 and has its rod end 24 connected to elongated, cylindrical, hollow soil probe 26. As seen in FIG. 8, soil probe 26 includes a cylindrical body portion 28 having an upper end 30, a conical-shaped nose cone portion 32 and a semi-circular door portion 34 which is hingedly secured to the cylindrical body portion 28 at 36. Springs 38 and 40 are provided, as illustrated in FIG. 8, to yieldably maintain the door 34 in its closed position. Actuating arm 42 is secured to door 34 and extends therefrom, as will be described in more detail hereinafter. The lower end of the rod 24 of hydraulic cylinder 22 is received by the upper end 30 and is secured thereto by means of pin 44 extending through soil probe 26 at 47. The exterior surface of nose cone 32 is provided with a plurality of longitudinally extending and outwardly protruding ribs 46 which help to fracture hard soil as the probe is inserted into the ground, making penetration easier and to also provide an air gap along the sides of the probe to break any suction which would make probe retraction difficult. Although it is preferred that four of the ribs 46 be provided, any number of ribs could be utilized.

Figure 9:
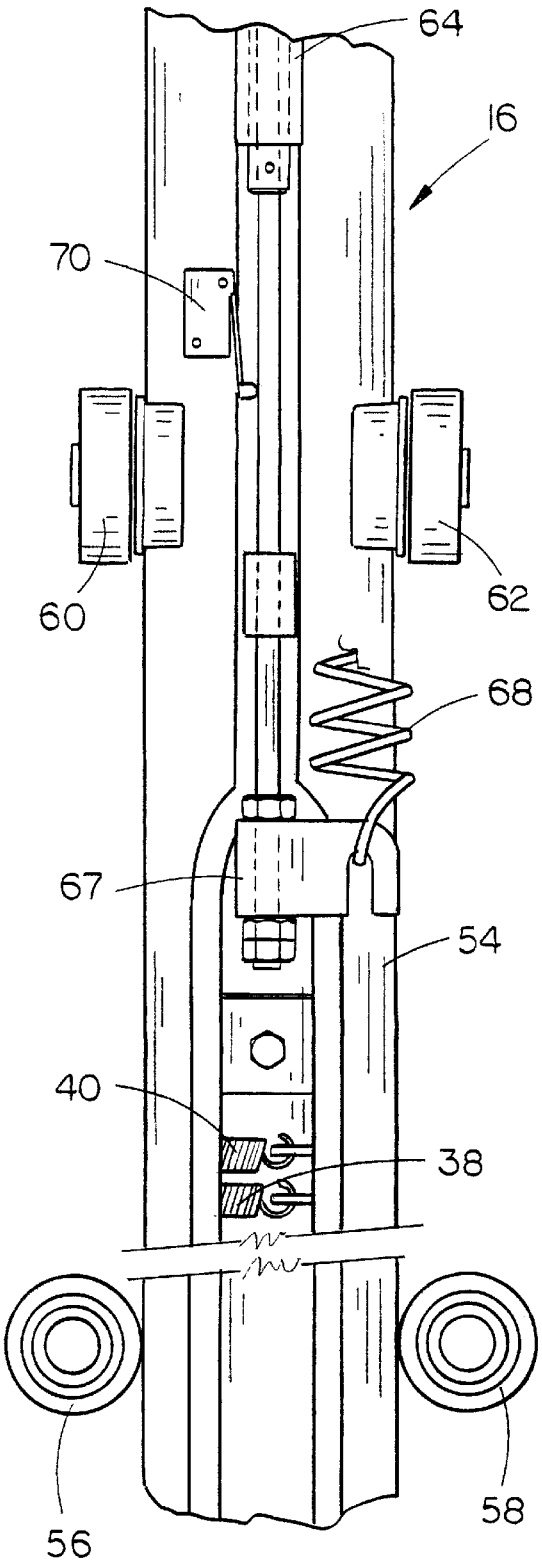
FIG. 9 is a partial rear view of the mast and the foot plate associated therewith for indicating the true position of the soil surface.
Figure 10:
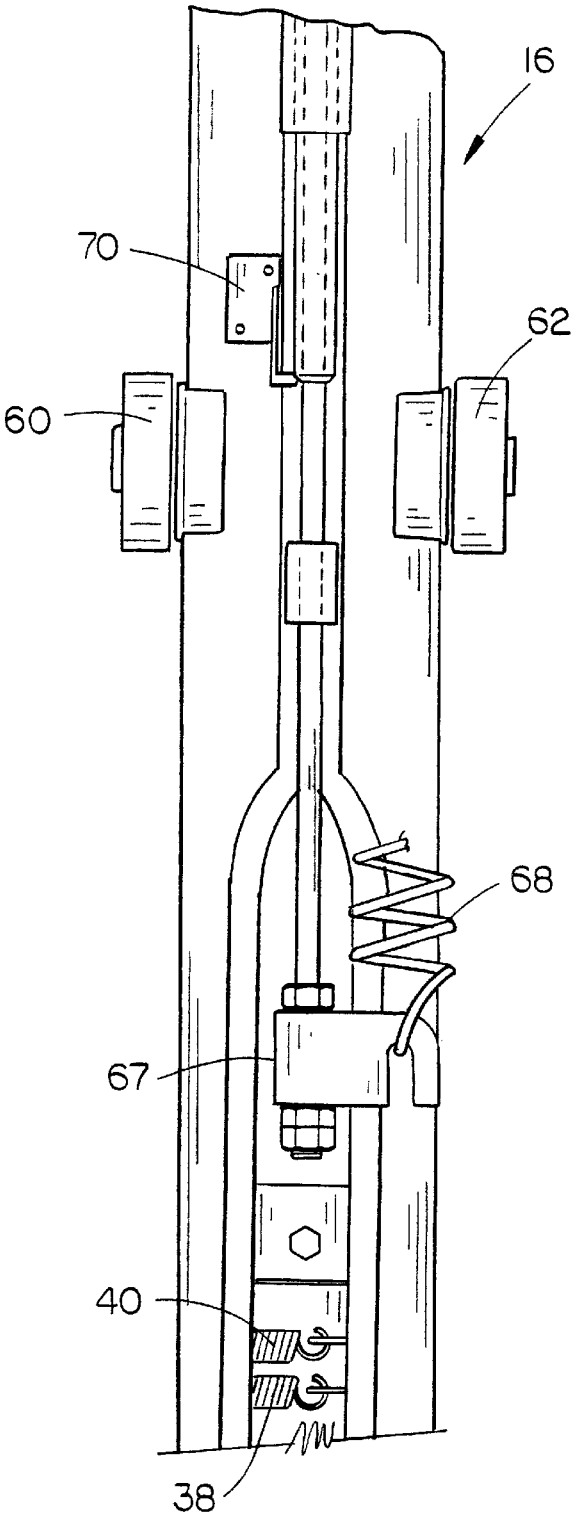
FIG. 10 is a view similar to FIG. 9 except that the probe has been lowered from the position of FIG. 9.

The numeral 48 refers generally to a foot plate assembly which is designed to indicate the true position of the soil surface as will now be described. Foot plate assembly 48 includes a lower end portion 50 having an opening 52 formed therein designed to permit the probe 26 to extend therethrough. Foot plate assembly 48 also includes a vertically disposed portion 54 which extends upwardly from lower end 50 which extends upwardly adjacent the mast 16, as illustrated in the drawings. Foot plate assembly 48 is vertically movably mounted with respect to the mast 16 with the mast 16 having a lower pair of rollers 56 and 58 as well as an upper pair of rollers 60 and 62 for guiding the movement of the foot plate assembly 48. Hydraulic cylinder 64 has its body operatively secured to the mast 16 and has its rod 66 secured to the vertically disposed portion 54 of foot plate assembly 48 at 67. Spring 68 extends between the connection 67 and a hook 69 operatively secured to the upper end of the foot plate assembly to assist the downward movement of the foot plate assembly 48 with respect to the mast assembly 16 when hydraulic cylinder 64 is extended and which ensures the foot plate assembly 48 remains in he soil engaged position irrespective of movement of mast assembly due to changes in soil penetration pressure. A micro-switch 70 (FIG. 9) is mounted on the mast assembly 16 for indicating the true position of the soil surface as will be explained in greater detail hereinafter.

Figure 7:
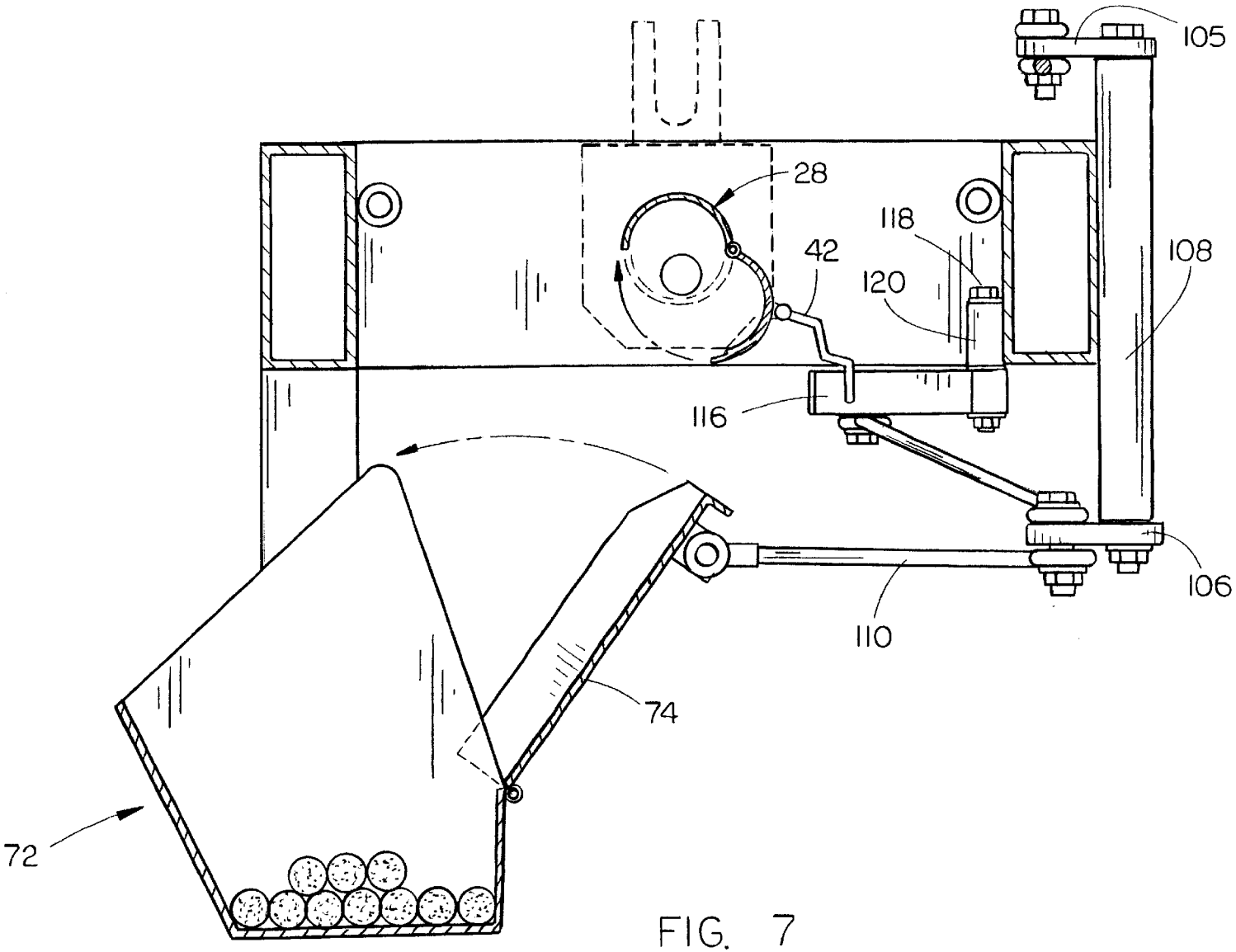
FIG. 7 is a partial sectional view illustrating the manner in which the soil sample is dumped from the probe into the collection receptacle.

The soil sample collection receptacle 72 having an open upper end is positioned beneath the frame means 14, as best illustrated in FIG. 7, and has a side wall portion 74 which is pivotally movable to the open position illustrated in FIG. 7 to effectively increase that width of the upper end of the receptacle 72.

Figure 3:
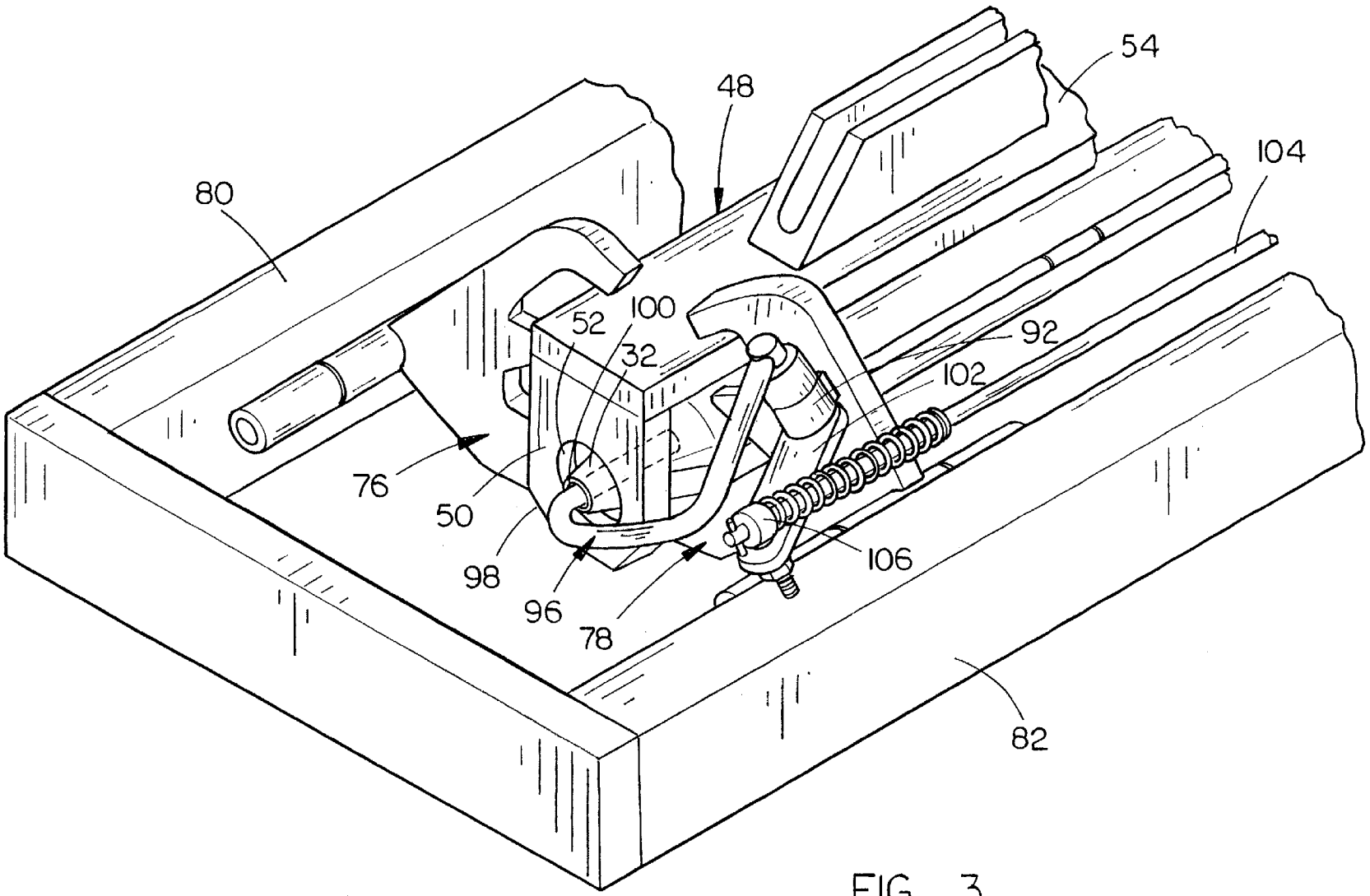
FIG. 3 is a partial perspective view illustrating the means for forcing soil from the nose cone of the probe.
Figure 4:
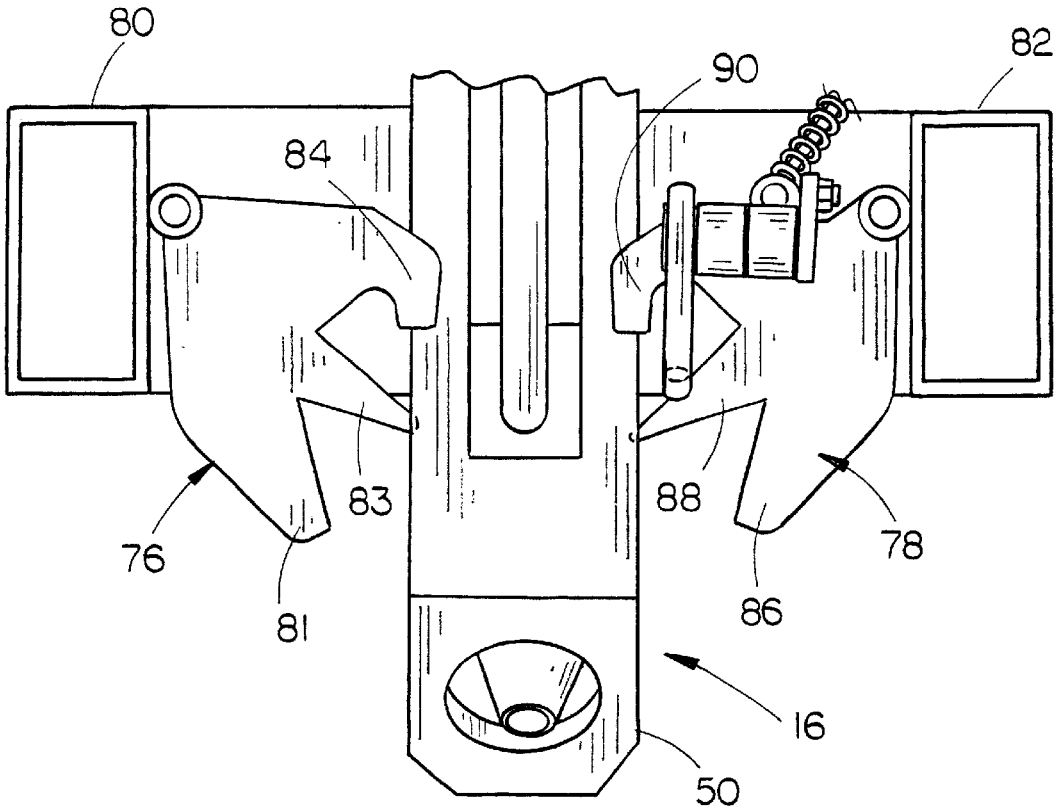
FIG. 4 is a rear view of the structure of FIG. 3 with the lower end of the mast being moved upwardly into the probe positioning means.
Figure 5:
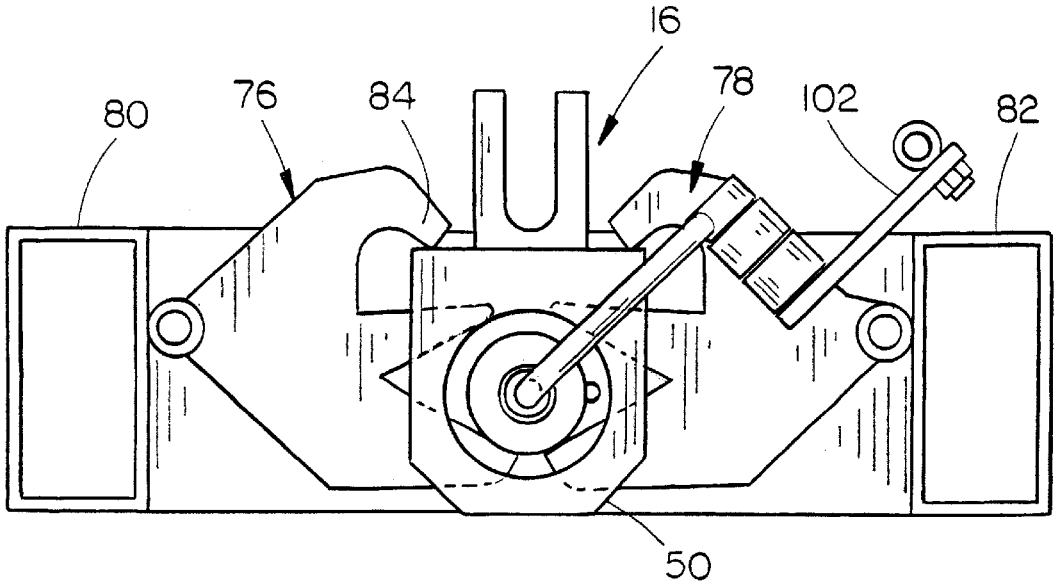
FIG. 5 is a rear view of the structure of FIG. 4 with the mast and probe being in the horizontally disposed position.

A pair of probe centering clamps 76 and 78 are pivotally mounted on the frame members 80 and 82 about horizontal axes, as illustrated in FIGS. 3, 4 and 5. Clamp 76 includes a lower inner end portion 81, intermediate inner end portion 83 and an upper inner end portion 84. Similarly, clamp 78 includes a lower end portion 86, intermediate end portion 88 and an upper inner end portion 90.

Figure 12:
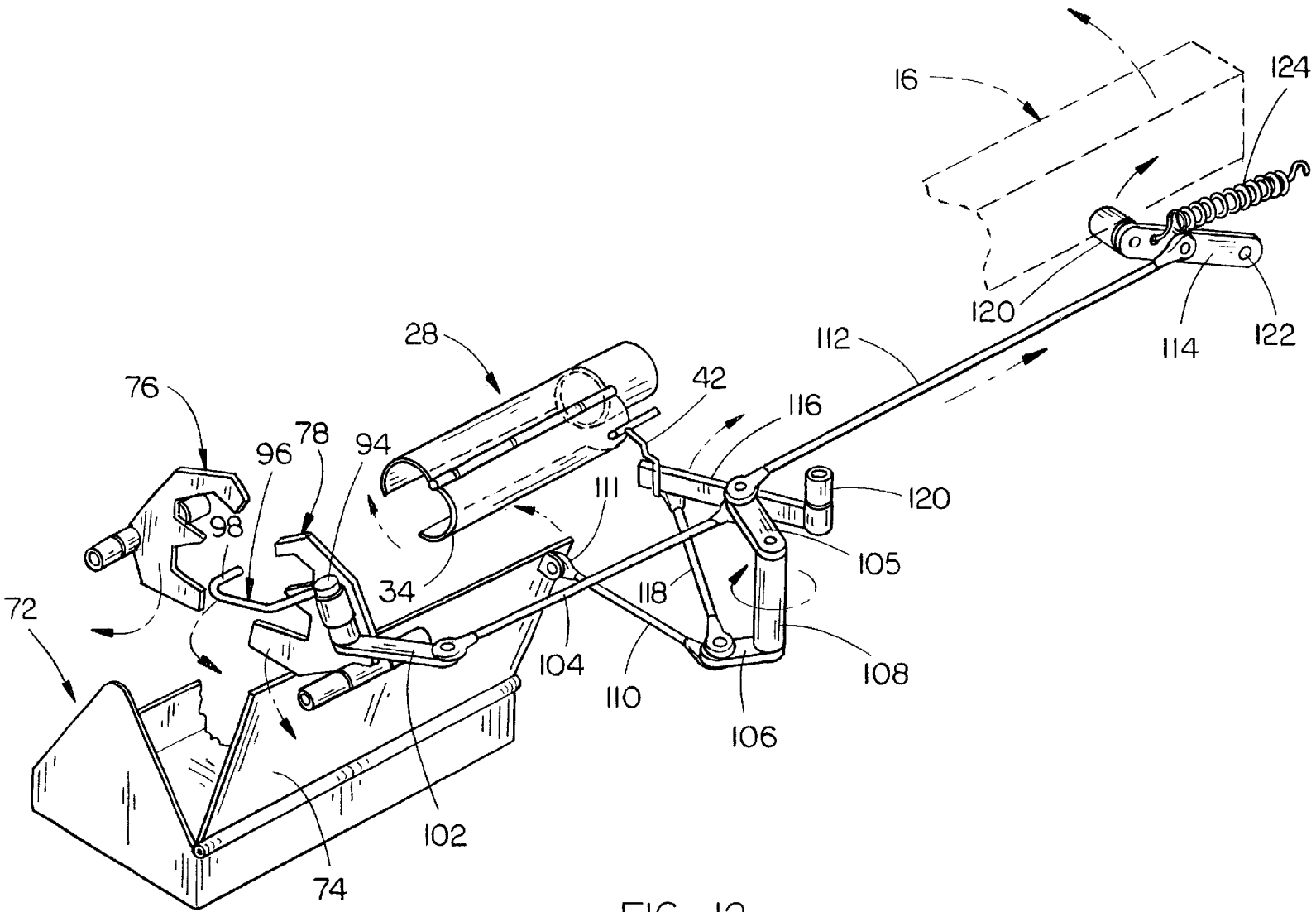
FIG. 12 is a perspective view illustrating certain of the structure.

Collar 92 is secured to the rearward side of clamp 78 and has a pin 94 rotatably or pivotally mounted therein. Clean-out arm 96 is secured to the pin 94 for movement therewith and has an end portion 98 provided thereon which is adapted to be extended through the opening 100 which extends through the conical-shaped nose cone portion 32. Arm 102 is secured to the lower end of pin 94 to cause pivotal or rotational movement of pin 94. The rearward end of rod 104 is pivotally connected to the outer end of arm 102 by means of a spring connection generally referred to by the reference numeral 106. The forward end of rod 104 is pivotally connected to a plate 105 which is welded to the upper end of a collar or sleeve 108 for rotation therewith. Arm 110 has one end thereof pivotally secured to the plate 106, which is welded to the lower end of collar or sleeve 108, and has its other end pivotally secured to the side wall portion 74 at 111, as illustrated in FIG. 12.

Rod 112 is pivotally secured to the outer end of plate 105 and has its forward end pivotally secured to arm 114. Arm 116 has one end pivotally mounted on a bolt 118 which is supported by a collar 120 secured to the frame member 82. The free end of arm 116 is adapted to engage the outer end of the actuating arm 42 to pivotally open the trap door 34, as will be described in more detail hereinafter. As seen in FIG. 12, one end of arm 118 is pivotally connected to plate 106 and has its other end pivotally connected to the arm 116.

Figure 2:
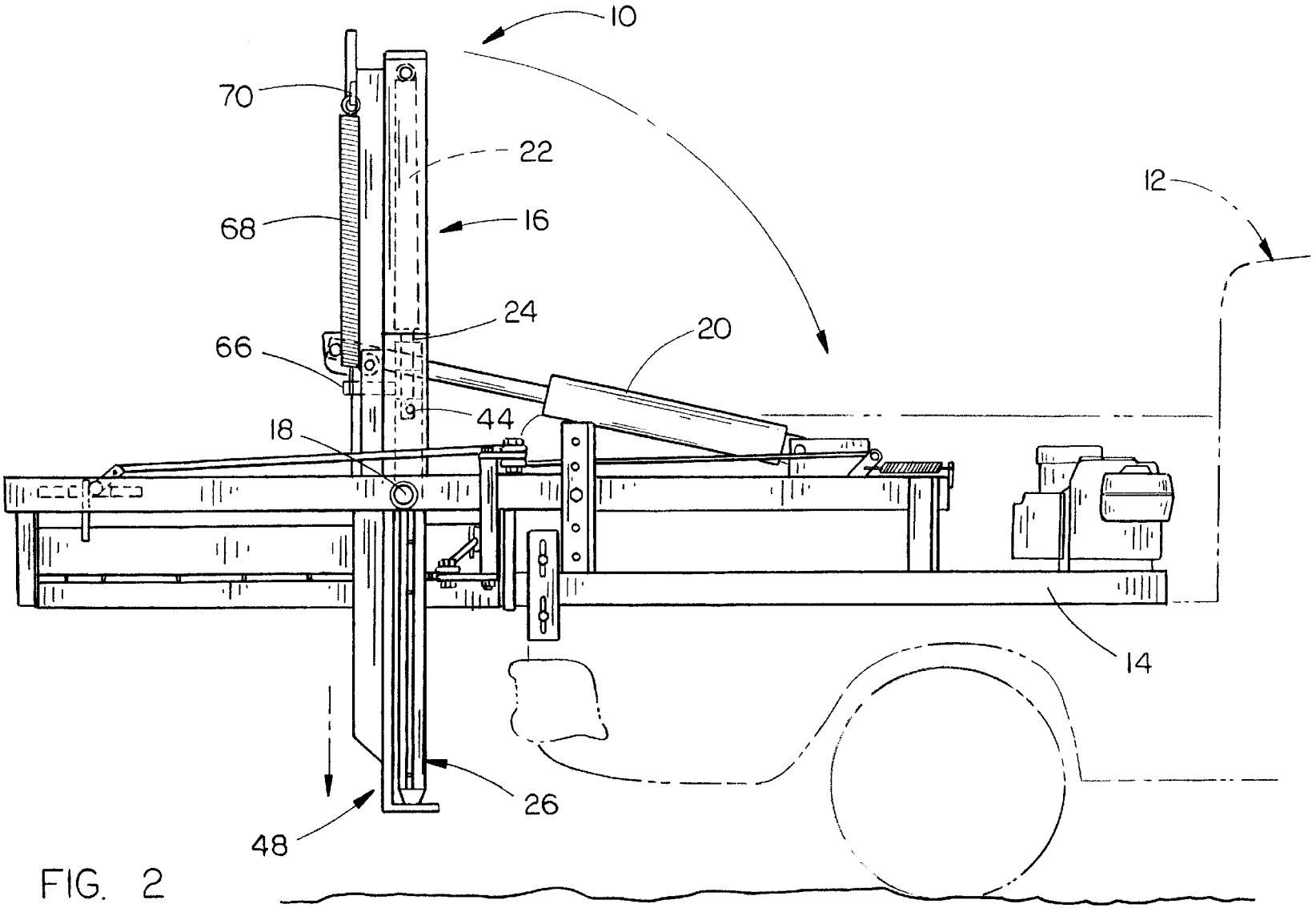
FIG. 2 is a side view of the structure of FIG. 1.
Figure 11C:
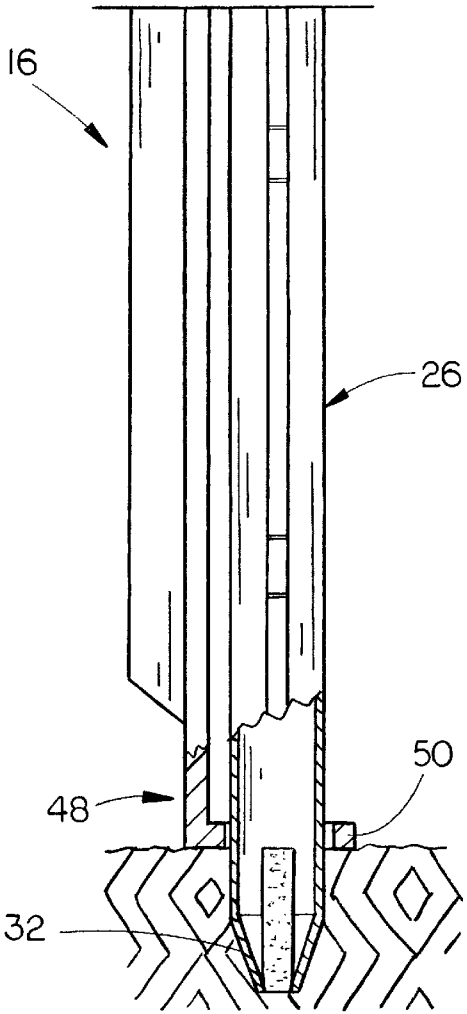
FIG. 11C is a view similar to FIG. 11B except that the probe has been initially moved downwardly into the soil to be sampled.
Figure 11B:
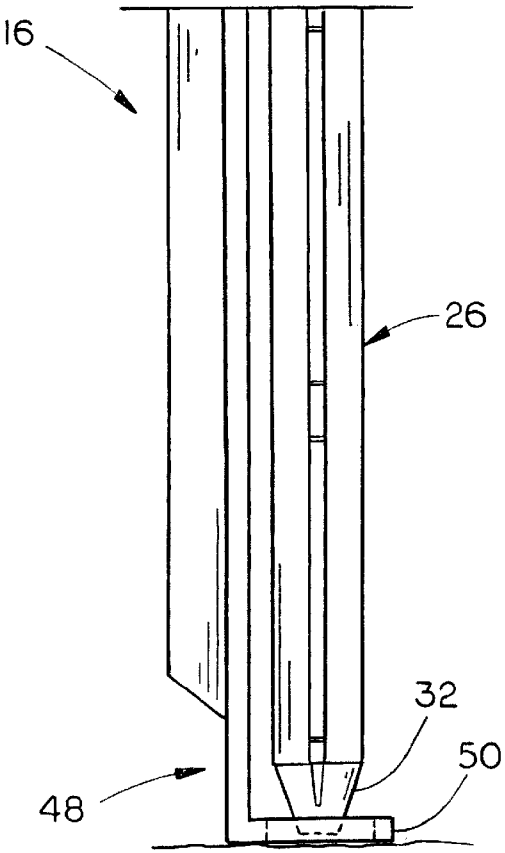
FIG. 11B is a view similar to FIG. 11A except that the foot plate of the apparatus has been lowered into ground-engaging position and the probe has been lowered to a position just above the ground.
Figure 11A:
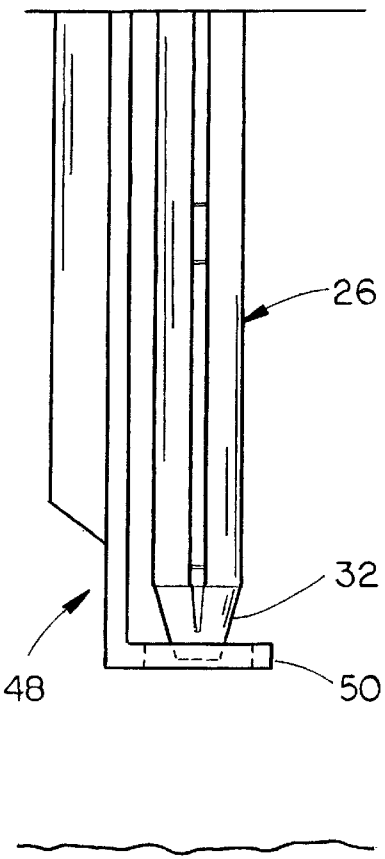
FIG. 11A is a side view illustrating the soil probe in its upper condition.

In operation, the mast assembly 16 would normally be in its substantially horizontally disposed position as the vehicle is driven to the field to be sampled. When the truck is positioned in the field, the hydraulic cylinder 20 is actuated to raise the mast assembly 16 to its vertically disposed position. At this time, the side wall portion 74 of receptacle 72 is in its "closed" position so that the upper end thereof is positioned laterally of the soil probe 26. At this time, the various components will be in the position illustrated in FIG. 2. Hydraulic cylinder 22 is then extended which causes the soil probe 26 and the foot plate assembly 48 to be moved from the position of FIG. 11A to the position of FIG. 11B. The micro-switch 70 senses the true position of the soil surface to ensure that the soil probe 26 will be inserted into the ground at the proper depth. Continued extension of the hydraulic cylinder 22 causes the probe 26 to be inserted into the ground with the ribs 46 performing the soil fracturing function described hereinabove. As the probe 26 is inserted into the ground, soil passes upwardly thereinto through the opening 100. When the probe 26 has been properly inserted into the soil to obtain the desired sample, hydraulic cylinder 22 is then retracted which causes the probe 26 and the foot plate assembly 48 to be moved upwardly to the position of FIG. 2. At that time, hydraulic cylinder 20 is retracted to cause the mast assembly 16 to be moved from its upright position to its horizontally disposed position.

FIG. 4 illustrates the position of the lower end of the foot plate assembly 48 and the soil probe 26 as the mast assembly 16 is being pivotally moved to its horizontally disposed position. As the mast assembly 16 nears its horizontally disposed position, the vertically disposed portion 54 of foot plate assembly 48 engages the upper inner end portions 84 and 90 of the clamps 76 and 78 to pivotally move the same upwardly from the position of FIG. 4 to the position of FIG. 5 with the clamps 76 and 78 engaging the soil probe 26, as illustrated in FIG. 5, to properly position and clamp the soil probe 26 into position as illustrated in FIGS. 3 and 5. The lowering of the upper end of the mast assembly 16 to its horizontally disposed position causes the engagement of the mast assembly 16 with the roller 120 which causes the arm 114, which is pivotally connected at its lower end to the frame means 14 at 122, to be moved downwardly which in turn causes the rearward movement of the rod 112. The rearward movement of rod 112, against the resiliency of the spring 124, causes the outer end of the plate 105 to be moved rearwardly which in turn causes rod 104 to be moved rearwardly. The rearward movement of rod 104 causes the arm 102 to pivot which in turn causes the clean-out arm 96 to be inserted into the opening 100 to clean-out the same. The rearward pivotal movement of the outer end of the plate 105 also causes the rotation of the sleeve 108 which causes the side wall portion 74 to be opened to the position of FIG. 7 so that the side wall portion 74 is located below the soil probe 26. Simultaneously with the opening of the side wall portion 74, the rotation of the plate 106 causes the arm 116 to be moved to engage the actuating arm 42 which in turn causes the trap door 34 to be moved to its open position so that the soil sample is dumped from the soil probe 26 into the receptacle 72. As the sample from the soil probe 26 is dumped into the receptacle 72, the partition 75 provided therein divides the soil sample into two segregated sample portions. When the sample has been dumped into the receptacle 72, the vehicle is driven forwardly to the next soil sampling location. When that location has been reached, the mast assembly 16 is again pivoted to its upright position which causes the arm 114 to pivotally move forwardly by the spring 124 so that the trap door 34 is closed and so that the clean-out rod is removed from the opening 100. Further, the forward movement of the upper end of the arm 114 causes the side wall portion 74 of receptacle 72 to be closed. The downward movement of the rearward or lower end of the mast assembly 16 causes the clamps 76 and 78 to release themselves from the soil probe. When the mast assembly 16 is in its upright position, the soil sampling procedure is repeated.

Thus it can be seen that the invention accomplishes at least all of its stated objectives.

We claim:

1. In combination with a wheeled vehicle, comprising:

a frame means secured to the vehicle;

an elongated mast, having upper and lower ends, pivotally mounted on said frame means about a horizontal axis;

said mast being pivotally movable between an upright position and a substantially horizontally disposed position;

means for pivotally moving said mast between its said upright and horizontally disposed positions;

an elongated, hollow soil probe, having first and second ends, longitudinally movably mounted on said mast and being movable from an upper retracted position to a lower soil penetrating position;

said soil probe including a conical-shaped soil-engaging nose portion at its said first end and a cylindrical body portion extending therefrom towards said second end thereof;

said cylindrical body portion including first and second semi-cylindrical body members pivotally secured together between open and closed positions to enable a soil sample therein to be dumped therefrom when in the said open position;

an elongated soil sample collection receptacle positioned beneath said cylindrical body portion when said probe is in its retracted position and said mast is in its horizontally disposed position;

and means for moving said body members to the said open position.

2. The combination of claim 1 wherein said means for moving said body members to the said open position is automatic.

3. The combination of claim 1 wherein said body members are spring-loaded to the said closed position.

4. The combination of claim 1 wherein said nose portion of said probe has an opening extending therethrough through which passes the soil sample as said probe is moved downwardly into the soil, and further including clean-out means which automatically moves through said opening in said nose portion when said probe is in its substantially horizontally disposed position and said body members are in their said open position to force soil in said opening therefrom.

5. The combination of claim 1 wherein said nose portion of said probe has a plurality of spaced-apart outwardly protruding longitudinally extending ribs on the exterior surface thereof.

6. The combination of claim 1 wherein said soil sample collection receptacle has at least one vertically disposed partition therein to divide the soil sample into at least two portions.

7. The combination of claim 6 wherein said collection receptacle includes first and second end walls, a bottom wall, and opposite side walls and wherein said partition extends between said side walls.

8. The combination of claim 6 wherein one of said side walls has a pivotal wall section which may be positioned beneath said probe when said probe is in its substantially horizontally disposed position.

9. The combination of claim 1 further including a soil position sensor which engages the surface of the soil and wherein said probe moves into said soil a predetermined depth in relation to said soil position sensor.

* * * * *